United States Patent [19]

Paul

[11] Patent Number: 4,866,904

[45] **Date of Patent: * Sep. 19, 1989**

[54] CEILING TILE SECTION SUPPORT

[76] Inventor: Harold J. Paul, 2015 Magnolia Ave., Pensacola, Fla. 32503

[ * ] Notice: The portion of the term of this patent subsequent to May 30, 2006 has been disclaimed.

[21] Appl. No.: 265,010

[22] Filed: Oct. 31, 1988

Related U.S. Application Data

[62] Division of Ser. No. 170,810, Mar. 21, 1988, Pat. No. 4,833,854.

[51] Int. Cl.[4] ..... E04B 1/38

[52] U.S. Cl. ..... 52/715; 52/484; 52/489

[58] Field of Search ..... 52/484, 489, 712, 715, 52/764, 765

[56] References Cited

U.S. PATENT DOCUMENTS

| | | | |
|---|---|---|---|
| 1,974,819 | 9/1934 | Koemer | 52/484 X |
| 3,422,590 | 1/1969 | Gwynne | 52/765 |
| 4,296,580 | 10/1981 | Weinar | 52/489 X |

FOREIGN PATENT DOCUMENTS

| | | | |
|---|---|---|---|
| 2845135 | 4/1980 | Fed. Rep. of Germany | 52/712 |

*Primary Examiner*—Carl D. Friedman
*Assistant Examiner*—Jerrold D. Johnson
*Attorney, Agent, or Firm*—George A. Bode; D. Neil LaHaye

[57] ABSTRACT

A ceiling tile section support. A flat rectangular main body portion has a plurality of wedge-shaped prongs extending laterally therefrom and at least two rectangular support members extending laterally from substantially the central portion of the main body portion in a direction opposed to that of the prongs. The prongs are inserted into the cut edge of a ceiling tile. The rectangular support members rest on a wall runner to support the cut edge of the ceiling tile.

13 Claims, 2 Drawing Sheets

CEILING TILE SECTION SUPPORT

This is a division, of application Ser. No. 07/170,810 , filed Mar. 21, 1988 now U.S. Pat. No. 4,833,854 date 5-30-88.

BACKGROUND OF THE INVENTION

1. Field of the Invention

The prsent invention relates generally to ceiling tile supports and, more particularly, to supports for ceiling tile sections to be fit along a wall.

2. General Background

In the installation of suspended ceilings, runners are attached to the walls at the desired height. Cross supports are then hung and interconnect with each other and the runners along the walls to form rectangles or squares of a pre-determined size equal to the ceiling tiles to be installed. The wall runners are typically L-shaped, while the cross supports form an inverted T-shape, but each side of the cross support presents an L-shape. The tiles are provided with beveled or, preferably, non-bevelled, but notched-edges on all four (4) sides in an L-shape which is substantially the mirror image of the runners to allow mating of the tile section edge to the runner. The depth of the beveled non-beveled but notched edge is sized so that when hung on the runner and cross supports, the bottom side of the tile extends a pre-determined distance below the bottom edge of the runner. This presents a level surface of tiles without revealing the notched edges which support the tiles and also provides for quick and easy installation once the runners are installed. However, since room dimensions rarely match that of the tiles being installed, it is often necessary to cut the tiles to special or "odd" sizes to fit along at least one or two walls. This necessitates cutting off at least one side of the tile with the pre-formed notched edge. As the notched edge must be a specific width and depth to provide proper support and fit, a means of cutting a new notched edge or, alternatively a different type of support is needed.

Various types of supports and fateners known include the following.

U.S. Pat. No. 2,807,063 issued to Berow discloses a sliding joint clamp adapted to be positioned between the abutting ends of wooden siding, as used on a dwelling house, for securing the abutting ends of the siding in end-to-end alignment.

U.S. Pat. No. 3,476,634 issued to Fleischmann discloses metal fastening means for joining new sheets of heat and sound insulating building materials together at their edges.

U.S. Pat. No. 3,331,180 issued to Vissing, et al. discloses a device for fastening wood or plastic wall and ceiling coverings to walls or ceilings without nailing through and thereby damaging the covering.

U.S. Pat. No. 1,905,616 issued to Zanella discloses a concrete form board holder to hold the boards edge-to-edge comprising a plane plate at each end of which is provided a set of lugs disposed to form a Z end-contour.

U.S. Pat. No. 2,084,544 issued to Wilson discloses a fastener for securing a wall board of sheet material to structural beams or studs.

U.S. Pat. No. 2,200,649 issued to Wardle discloses a clip for the anchorage of artificial siding to a wall with one side of the clip adapted to be secured to the wall and the other overlapping the tongue portion of the siding and penetrating adjacent siding sections.

U.S. Pat. No. 2,258,574 issued to Leary discloses a clip for wall construction with a web having a pair of flanges extending generally in the same direction at right angles to the plane of the web. One of the flanges bears against the stud and the other laps upon the outer face of the panel to be installed once the clip is nailed into position.

U.S. Pat. No. 3,261,137 issued to Jureit discloses a fastener for attaching wall board to studding wherein the fastener is driven into the studding.

Although the above patents disclose a number of fasteners, none address the problem referred to hereinabove. This presents the need for a tile support section which is inexpensive, safe and easy to use. This is preferable to a special tool for recutting a new matched edge, as such a tool would be bulky, expensive and present another potential device to generate an industrial accident.

SUMMARY OF THE PRESENT INVENTION

The preferred embodiment of the apparatus of the present invention solves the aforementioned problem in a straight forward and simple manner. What is provided is a ceiling tile section support which is embedded into the straight cut edge of a ceiling tile section. Flat wedge-shaped prongs extend from a main body portion and penetrate the tile. Rectangular support members which extend from the main body portion in a direction opposite from the wedge-shaped prongs rest on the runner along the wall to support the cut edge of the tile.

In view of the above, it is an object of the present invention to provide a ceiling tile section support which provides support to the straight cut edge of the tile for ease of installation.

BRIEF DESCRIPTION OF THE DRAWING

For a further understanding of the nature and objects of the present invention, reference should be had to the following description, taken in conjunction with the accompanying drawing, in which like parts are given like reference numerals and, wherein.

DETAILED DESCRIPTION OF THE PREFERRED EMBODIMENT

Figure 1:
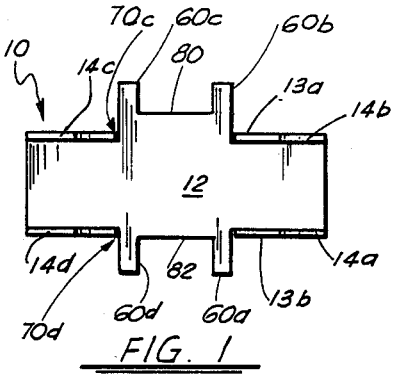
FIG. 1 is a top view of the preferred embodiment of the apparatus of the present invention.
Figure 3:
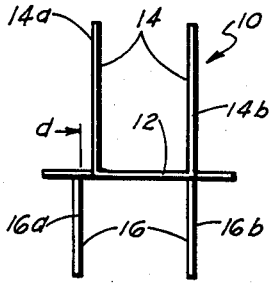
FIG. 3 is a side elevational view of the embodiment of FIG. 1.

Referring now to the drawing, and in particular FIGS. 1–7, the apparatus of the present invention is designated generally by the numeral 10. Ceiling tile section support 10 is generally comprised of main body portion 12, a plurality wedge-shaped prongs 14, and rectangular support members 16.

Main body portion 12 is formed from any suitable rigid material such as aluminum or galvinized steel (or plastic or vinyl) and has a flat rectangular surface with wedge-shaped or triangular-shaped prongs 14 and rectangular support members 16 formed integrally therewith.

Figure 2:
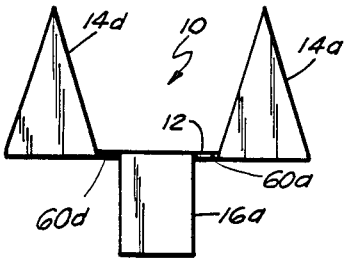
FIG. 2 is a front elevational view of the embodiment of FIG. 1.
Figure 4:
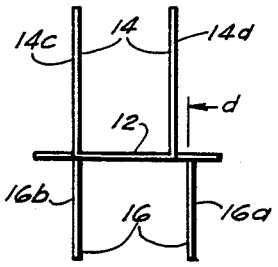
FIG. 4 is a side elevational view of the embodiment of FIG. 1, the side being the side opposite that shown in FIG. 3.
Figure 5:
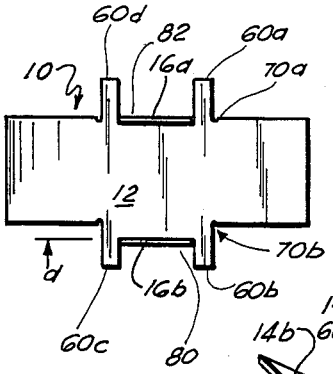
FIG. 5 is a bottom view of the embodiment of FIG. 1.
Figure 6:
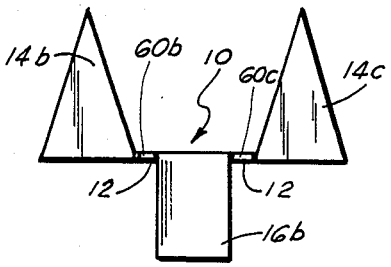
FIG. 6 is a rear elevational view of the embodiment of FIG. 1.
Figure 7:
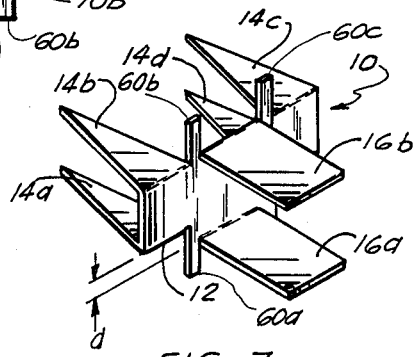
FIG. 7 is a bottom perspective view of the embodiment of FIG. 1.
Figure 11:
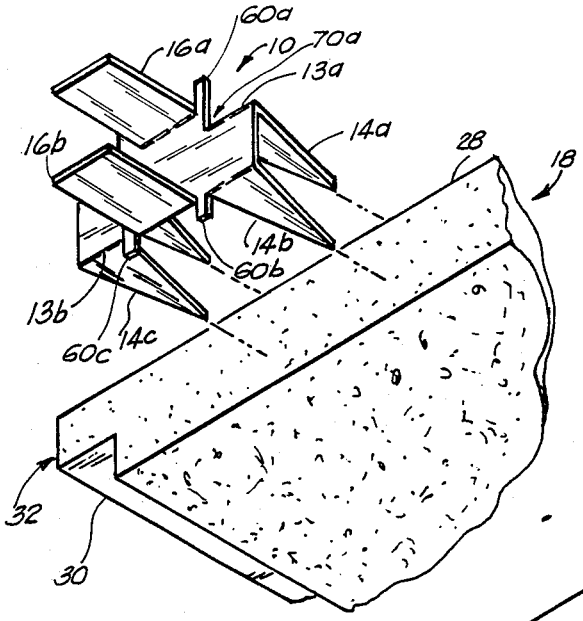
FIG. 11 illustrates the positioning of the embodiment of FIG. 1 immediately prior to installation in a ceiling tile section with one cut edge.
Figure 12:
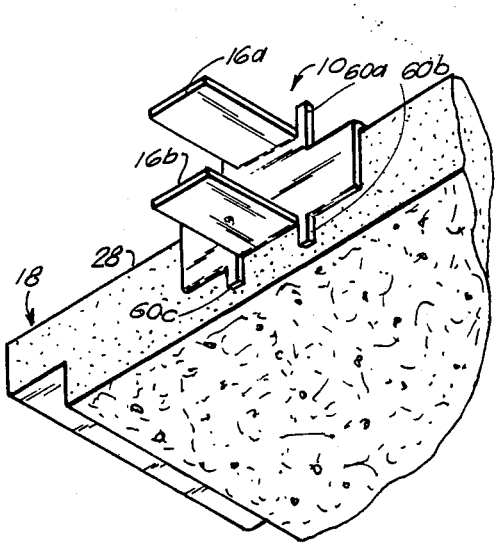
FIG. 12 illustrates the embodiment of FIG. 1 installed in a ceiling tile section; and, FIG. 13 illustrates the embodiment of FIG. 1 installed and supporting a cut ceiling tile section on a wall runner.
Figure 13:
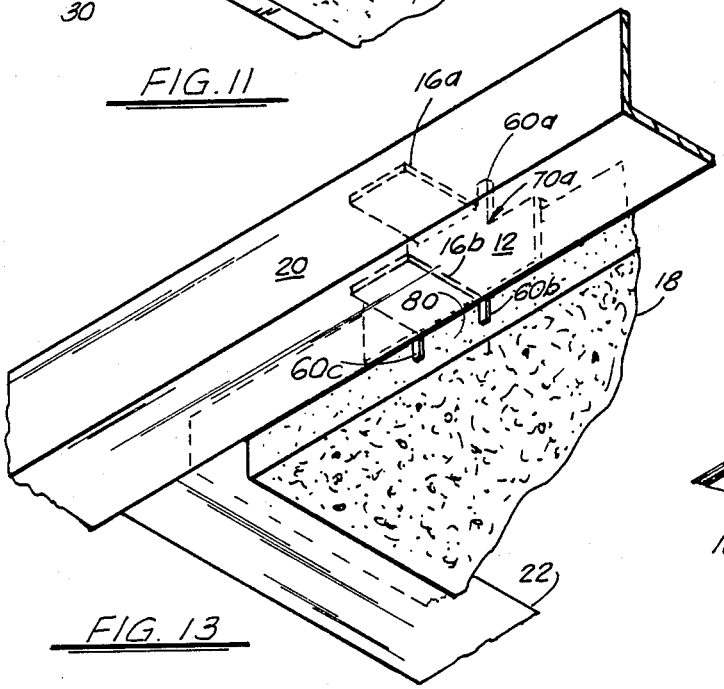

In the preferred embodiment of FIGS. 1–7, four (4) wedge-shaped prongs 14 extend laterally outwardly from the opposing edges (defined for reference as the upper and lower edges 13*a*, 13*b* of FIGS. 1, 7, 11, 12 and 13) of main body portion 12. As best seen in FIGS. 2, 6, and 7, prongs 14 extend laterally from near each corner of main body portion 12 or at a ninety (90°) degree angle thereto, thus spaced and opposed in pairs. Prongs 14 are wedge-shaped and sharply pointed in the preferred embodiment for ease of penetration into the cut straight edge 28 of ceiling tile section 18, as best seen in FIGS. 11, 12 and 13.

Rectangular support members 16 extend laterally outwardly from the upper and lower edges 13*a*, 13*b* of substantially the central portion of main body portion 12 in a direction diametrically opposed to that of prongs 14. Two (2) spaced and parallel support members 16 are provided in the prferred embodiment.

Protrusions 60*a–d* extend longitudinally upwardly and downwardly from opposed marginal side edges of main body portion 12, as best seen in FIGS. 1, 5, 7 and 11–13. Protrusions 60*a* and 60*d* thus define gap 82 and protrusions 60*b* and 60*c* define gap 80 therebetween. Each protrusion 60 is thus located intermediate a prong 14 and support member 16, i.e., protrusion 60*a* is intermediate prong 14*a* and support member 16*a*. Notches 70*a–d* are formed by the juncture of protrusions 60*a–d*, prong 14*a–d* and main body portion 12, respectively. Protrusions 60 add stability to support 10 when employed in the manner best illustrated in FIGS. 11–13.

Figure 8:
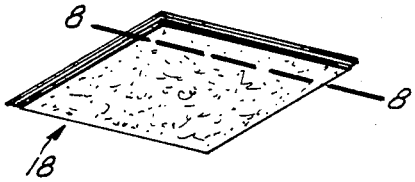
FIG. 8 illustrates an uncut ceiling tile section having four (4) matched edges.
Figure 10:
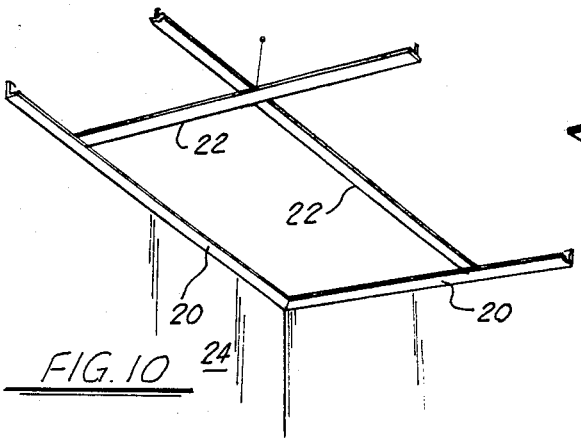
FIG. 10 illustrates installed wall runners and cross supports for supporting ceiling tile sections to be installed.
Figure 9:
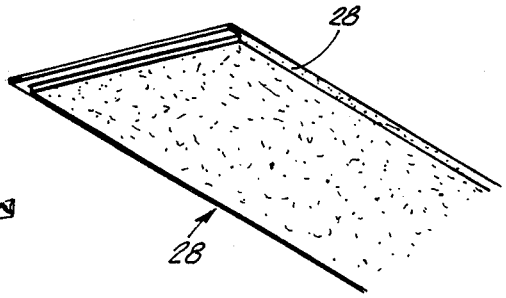
FIG. 9 illustrates the ceiling tile section of FIG. 8 with one edge thereof cut to fit a wall runner.

Use of apparatus 10 is best illustrated in FIGS. 8–13. Wall runners 20 and cross supports 22 are first installed at the desired height along walls 24. As best seen in FIG. 8, tile section 18 is measured to fit in runner 20 along wall 24 and is therefore, cut along Line 8—8. As best seen in FIG. 9, this results in cut edge 28 which is no longer notched but straight. In order to now support cut straight edge 28 in wall runner 20, the lower set of wedge-shaped prongs 14 (defined for reference purposes as 14*b*, 14*c* in FIGS. 7 and 11) and support members 16 (defined for reference purposes as 16b in FIGS. 7, 11, 12 and 13) are aligned with the horizontal portion 30 of notched edge 32, as illustrated in FIG. 11. Lower wedge-shaped prongs 14 (14*b*, 14*c*in FIG. 11) are then inserted into cut straight edge 28 of tile section 18 with the upper set of prongs 14 (14*a*, 14*d* in FIGS. 7 and 11) abutting the top of ceiling tile section 18, as best illustrated in FIG. 12. Ceiling tile section 18 is then hung between runner 20 and cross support 22. Notched edge 30 is supported by cross support 22. Cut straight edge 28 now does not contact the interior of wall runner 20, but, as best seen in FIG. 13, is supported by lower rectangular support member 16 (16*b* of FIG. 11) which rests on the horizontal portion of runner 20. Although ceiling tile section support 10 is illustrated as having four (4) wedge-shaped prongs 14 and two (2) rectangular support members 16 in the preferred embodiment, it should be understood that ceiling tile section support 10 may be further elongated and provided with a larger number of prongs 14 and rectangular support members 16.

Ceiling Tile section support 10 in the preferred embodiment is not symmetrical so that it can be used for tile sections of varying thickness ($\frac{5}{8}''$ and $\frac{3}{4}''$ thickness are industry standards). As best seen in FIGS. 3–5 and 7, rectangular support 16*b* is laterally aligned in the same horizontal plane with one pair of wedge-shaped prongs 14*b*, 14*c*, while rectangular support 16*a* is not laterally aligned in the same horizontal plane with the other pair of wedge-shaped prongs 14*a*, 14*d*, but offset therefrom a vertical distance "d." (For example, if FIG. 11 illustrates the $\frac{5}{8}''$ thickness of tile and the cut is $\frac{1}{2}''$, than a 1/16" offset exists).

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A ceiling tile section support provided for the non-beveled edges of a ceiling tile section, comprising:
   (a) a substantially flat main body portion having opposed marginal side edges;
   (b) a plurality of prongs laterally extending from a first surface of said main body portion;
   (c) at least two support members laterally extending from the surface opposing said first surface of said main body portion and in a direction opposed to that of said prongs; and,
   (d) a plurality of protrusions longitudinally extending from said opposing marginal side edges of said main body portion.

2. The support of claim 1, wherein said prongs extend laterally outwardly from said main body portion at substantially a ninety (90°) angle thereto.

3. The support of claim 1, wherein said prongs are wedge-shaped.

4. The support of claim 1, wherein four of said prongs extend from said main body portion.

5. The support of claim 1, wherein said support members are rectangularly shaped.

6. A ceiling tile section support provided for the non-beveled edges of a ceiling tile section, comprising:
   (a) a substantially flat main body portion having opposed marginal side edges;
   (b) a plurality of prongs extending laterally from a first surface of said main body portion and adjacent to each corner of said main body portion;
   (c) at least two support members extending laterally substantially from the central portion of the surface opposing said first surface of said main body portion and in a direction opposed to that of said prongs; and,
   (d) a plurality of protrusions, each protrusion being intermediate one of said prongs and one of said support members, extending longitudinally from said opposing marginal side edges of said main body portion.

7. The support of claim 6, wherein said prongs are wedge-shaped.

8. The support of claim 6, wherein four of said prongs extend from said main body portion.

9. The support of claim 6, wherein said support members are rectangularly shaped.

10. A ceiling tile section support provided for the non-beveled edges of a ceiling tile section, comprising:

(a) a substantially flat rectangular main body portion having opposed marginal side edges;

(b) a plurality of prongs extending laterally outwardly from a first surface of said main body portion at opposing edges of said main body portion adjacent the ends thereof;

(c) at least two support members extending substantially laterally from the central portion of the surface opposing said first surface of said main body portion and in a direction diametrically opposed to that of said prongs; and, (d) a plurality of protrusions, each protrusion being intermediate one of said prongs and one of said support members, extending longitudinally from said opposing marginal side edges of said main body portion.

11. The support of claim 10, wherein said prongs are wedge-shaped.

12. The support of claim 10, wherein four of said prongs extend from said main body portion.

13. The support of claim 10, wherein said support members are rectangularly shaped.

* * * * *